US011236408B1

(12) United States Patent
Fang et al.

(10) Patent No.: US 11,236,408 B1
(45) Date of Patent: Feb. 1, 2022

(54) CEMENTED TUNGSTEN CARBIDE WITH FUNCTIONALLY DESIGNED MICROSTRUCTURE AND SURFACE AND METHODS FOR MAKING THE SAME

(71) Applicant: University of Utah Research Foundation, Salt Lake City, UT (US)

(72) Inventors: Zhigang Zak Fang, Salt Lake City, UT (US); Kyu Sup Hwang, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 0 days.

(21) Appl. No.: 17/172,874

(22) Filed: Feb. 10, 2021

(51) Int. Cl.

| | |
|---|---|
| ***C22C 1/06*** | (2006.01) |
| ***C22C 1/05*** | (2006.01) |
| ***C22C 29/00*** | (2006.01) |
| ***C22C 29/08*** | (2006.01) |

(52) U.S. Cl.
CPC ..... *C22C 1/06* (2013.01); *C22C 1/051* (2013.01); *C22C 29/005* (2013.01); *C22C 29/08* (2013.01)

(58) Field of Classification Search
CPC ..... C22C 1/051; C22C 29/00; C22C 29/08; C22C 1/06; C22C 29/005
See application file for complete search history.

(56) References Cited

U.S. PATENT DOCUMENTS

2005/0019614 A1* 1/2005 Miura ..... C22C 1/051 428/698

* cited by examiner

*Primary Examiner* — Jessee R Roe
(74) *Attorney, Agent, or Firm* — Thorpe North & Western

(57) ABSTRACT

A method of forming a functionally designed cemented tungsten carbide can include forming a particulate matrix mixture including a primary particulate tungsten carbide and a primary particulate metal binder. A particulate enhancement mixture can be formed having a secondary particulate tungsten carbide, a secondary particulate metal binder, and a particulate grain growth inhibitor, where the enhancement mixture has a finer particle size than the matrix mixture. The particulate matrix mixture can be assembled with the particulate enhancement mixture to form a structured composite where the matrix mixture forms a continuous phase and the enhancement mixture forms at least one of a dispersed granular phase and a surface layer adjacent the continuous phase to form the structured composite. This structured composite can be sintered to form the functionally designed cemented tungsten carbide having a differential grain size with the enhancement phase having a smaller grain size than the matrix phase.

16 Claims, 3 Drawing Sheets

CEMENTED TUNGSTEN CARBIDE WITH FUNCTIONALLY DESIGNED MICROSTRUCTURE AND SURFACE AND METHODS FOR MAKING THE SAME

BACKGROUND

Cemented tungsten carbide materials can contain a metal binder and functionally graded composition. Functionally graded tungsten carbides have been made to balance toughness and hardness for a variety of industrial applications. The metal binder can typically be cobalt, nickel, iron or alloys thereof. Such functionally graded materials may be used for metal cutting tools, rock drilling tools for oil exploration, mining, construction and road working tools, metal-forming tools, metal-shaping tools, and other applications. Illustrative examples of functionally graded materials can be found in U.S. Patent Application Publication No. 2005/0276717, U.S. Pat. Nos. 5,880,382; 8,163,232; 8,936,750; and 9,388,482 which are each expressly incorporated herein by reference.

As explained in the prior patent publications noted above, it is desirable to construct a cemented tungsten carbide material ("WC" material) that includes an amount of metal binder in order to seek materials that have a superior combination of toughness and wear-resistance. Some cemented tungsten carbide, including large volume fractions of WC particles in a metal binder matrix, are one of the most widely used industrial tool materials for metal machining, metal forming, mining, oil and gas drilling and other similar applications.

Manufacturing of cemented tungsten carbide with non-uniform microstructure is however a difficult challenge. Cemented tungsten carbide is typically sintered via liquid phase sintering (LPS) process in vacuum. Unfortunately, when cemented tungsten carbide with a cobalt or grain size gradient within the microstructure is subjected to liquid phase sintering, migration of the liquid metal binder and the WC grains occur and the gradient of metal binder or grain size is easily eliminated or minimized. This results in moderated or no performance advantages.

SUMMARY

A functionally designed cemented tungsten carbide material can contain a metal binder with a functionally designed and fabricated microstructure which is preserved in a sintered product. In order to form and preserve a desired functionally designed microstructure a composite and structured mixture of WC, binder and grain growth inhibitor can be formed.

Compared with conventional cemented tungsten carbide, cemented tungsten carbide with functionally designed microstructure and surface (FDM cemented tungsten carbide) can be formed with a microstructure having multiple regions with different hardness values distributed throughout the body and offers a superior combination of mechanical properties. For example, FDM cemented tungsten carbide can include two grades of cemented tungsten carbide. A first grade of WC-metal binder material forms the matrix, and a second grade of WC-metal binder-grain growth inhibitor in the form of small granules that are embedded in and distributed within and throughout the matrix. The second grade also has higher hardness than the first grade after sintering. The second grade can also form a surface layer on top of the first grade which forms the bulk of a component to provide enhanced wear resistance.

Although not required, the first and the second grade can have approximately the same cobalt (or other metallic binder) content. The second grade can have finer grain size than the first grade. As a general guideline, a hardness of the second grade is at least 50 points on a Vickers hardness scale (Hv 50) higher than that of the first grade in the final product. The FDM can also be a composite of the two or more grades. The first grade is the matrix phase while the second grade is the enhancement phase distributed within the matrix phase. The FDM composite demonstrates better wear-resistance performance than the matrix phase without the enhancement phase, resulting from a boost to wear resistance without sacrificing toughness and impact resistance of the matrix. In another alternative, the FDM can have a uniform surface layer made of the second grade that is free of any such composite granules.

In each case, the presence of the grain growth inhibitor during sintering mitigates migration of tungsten carbide (WC) particles between the two grades. This means that the final product has very distinct regions of controlled microstructure (i.e. hardness of the second grade is higher than the first grade). Notably, the percentage of metal binder can often be generally equal in both grades/phases, or they can differ within a range. Further in some cases, there is no η-phase carbides or other complex carbides, and substantially free of free-carbon (i.e. near stoichiometric carbon to tungsten ratio) in the final product. Optionally, a third and fourth grade could be added (e.g. additional different grain sizes and/or different metal binder).

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
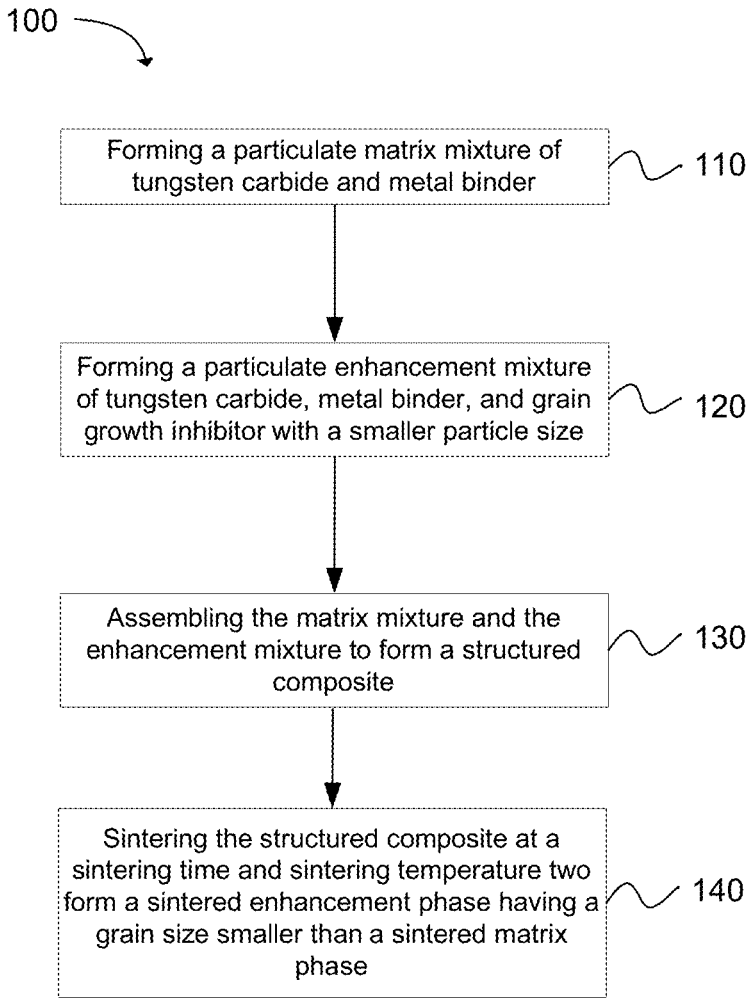
FIG. 1 is a flow chart of a method of forming a functionally designed cemented tungsten carbide in accordance with one example.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

The singular forms "a," "an," and "the" include plural referents unless the context clearly dictates otherwise. Thus, for example, reference to "a particle" includes reference to one or more of such materials and reference to "subjecting" refers to one or more such steps.

As used herein, the term "about" is used to provide flexibility and imprecision associated with a given term, metric or value. The degree of flexibility for a particular variable can be readily determined by one skilled in the art. However, unless otherwise enunciated, the term "about" generally connotes flexibility of less than 2%, and most often less than 1%, and in some cases less than 0.01%.

As used herein, "functionally designed" refers to a composite microstructure having distinct regions within a sintered cemented tungsten carbide material which are varied terms of mechanical properties and which are not graded throughout. Rather, the distinct regions have identifiable boundaries in which composition, grain size and/or other properties vary, although there may be some minor amount of gradation at region interfaces.

As used herein, "cemented tungsten carbide" refers to a sintered tungsten carbide having a metal binder distributed throughout.

As used herein, "particulate" refers to a morphology of pieces of material having sizes less than about 500 μm and often smaller as outlined in more detail below. Particulate materials can be considered powder and may have varied shapes, e.g. irregular, spherical, crystalline, or the like. Generally particulate material can be flowable and compacted into a green body. Under compaction, particulate materials can become mechanically agglomerated or partially sintered to form a fragile mass which may be crushed to separate particles.

As used herein, "granular" refers to an agglomerated mass including a plurality of particulate materials. Although a granular composition can be homogenous, it is often a composite granular composition having multiple different components (e.g. tungsten carbide, metal binder, and/or grain growth inhibitor).

As used herein, "sintered" refers to partial or full sintering where at least some adjacent particles fuse and melt together through necking. As materials become more fully sintered, density increases and voids between particles decreases. A fully dense material is one in which density reaches above about 99% by volume of the theoretical density of the material (and some cases higher than 99.9%) leaving almost no voids. Partially sintered materials may have a density of about 65% by volume or greater, and often 80% by volume or greater.

As used herein, "particle size" refers to an average particle size. In most cases, particles will exhibit at least some particle size distribution. However, as a non-limiting example, the particle size distribution can have a lognormal distribution, for example of which D50 is 2 micrometers, D10 in 0.2 micrometers, and D90 is 5 micrometers.

As used herein, "structured composite" refers to an intermediate non-sintered material having distinct regions with different particle size and/or composition.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

As used herein, the term "at least one of" is intended to be synonymous with "one or more of." For example, "at least one of A, B and C" explicitly includes only A, only B, only C, and combinations of each.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Cemented Tungsten Carbide with Functionally Designed Microstructure

Referring generally to FIG. 1, a method 100 of preparing a cemented tungsten carbide with functionally designed microstructure and surface can include forming a particulate matrix mixture 110 comprising a primary particulate tungsten carbide and a primary particulate metal binder. The particulate matrix mixture can have a first particle size and the primary particulate metal binder can be present at a first binder concentration.

The method can also include forming a particulate enhancement mixture 120 comprising a secondary particulate tungsten carbide, a secondary particulate metal binder, and a particulate grain growth inhibitor. The particulate enhancement mixture can have a second particle size which is smaller than the first particle size and the secondary particulate metal binder being present at a second binder concentration.

Further the method can include assembling the particulate matrix mixture with the granular enhancement mixture to form a structured composite 130. The particulate matrix mixture forms a continuous phase and the granular enhancement mixture forms at least one of a dispersed granular phase and a surface layer adjacent the continuous phase to form the structured composite as outlined below and illustrated generally in FIGS. 2A-4.

The structured composite can be sintered 140 to form the functionally designed cemented tungsten carbide at a sintering temperature and a sintering time which is sufficient to sinter the continuous phase to form a matrix having a primary grain size, and to sinter the at least one of the dispersed granular phase and the surface layer having a secondary grain size to form an enhancement phase. The choice of materials and conditions also results in the secondary grain size being smaller than the primary grain size.

The particulate tungsten carbide can be obtained from commercial sources or formed directly through carburization, chemical vapor deposition, or the like. The particulate tungsten carbide can also be generally free of any other components as a starting material. Although not required, secondary carbides may also be added such as, but not limited to, carbides of Ti, Ta, Nb, Cr, Mo, V, Zr, mixtures of these, and the like. The particle size of the particulate tungsten carbide can also vary considerably depending on the application. However, as a general guideline, the particulate tungsten carbide in the matrix mixture can be a relatively large size of about 1 μm to 10 μm, and in some cases up to 20 μm. However, in some cases, the particulate tungsten carbide can be about 100 nm to about 800 nm. Notably, the particulate tungsten carbide in the enhancement mixture can be similarly chosen, albeit with a smaller particle size. As a general guideline, the second particle size can be 100 nm to 2 μm. The second grade, i.e. the enhancement phase, granules (WC plus binder) may have granule sizes in some cases from 30 to 200 μm, and in yet other cases 20 to 500 μm. Although the ranges for carbide grain sizes in the first and second grade overlap, it is noted that the condition of the second carbide particle/grain size being smaller than the first carbide particle/grain size is still maintained. Thus, a first particle/grain size of 1 μm would mean that the second particle/grain size would be less than 1 μm in that example. Although sizes can be varied, as a general rule, the second particle/grain size can be at least 20% smaller than the first particle/grain size. Generally if the starting size of the first WC particles is larger than the second WC particles, they will be larger after sintering.

After sintering, the primary grain sizes can be either substantially the same or larger than a starting particle size. Although size increases can vary depending on process temperatures and times, final grain sizes can be about 1.0 to 5 times an initial grain size, and in some cases 1.8 to 2.5 times. Conversely, after sintering, the second grain sizes may be substantially the same, or within about 5% of a starting second particle size. Further, even when the second grain sizes increase, the final second grain sizes can still be smaller than the primary grain sizes by 20% or more.

The particulate tungsten carbide as a starting material can also be chosen to have a desired carbon to tungsten ratio. The carbon to tungsten ratio can be one factor which is varied in order to achieve different complex carbides in a final product after sintering. For example, the carbon content in either or both the primary and secondary tungsten carbide can be approximately stoichiometric (e.g. 6.125% by weight) or from 6.0 to 6.13% by weight of the respective tungsten carbide. These contents can generally be maintained after sintering such that the functionally designed cemented tungsten carbide can be substantially free of η phase carbides and free-carbon. However, the carbon content in the enhancement phase may be designed to minimize inter-flow of the liquid cobalt phase from the matrix phase to the enhancement phase. However, during the sintering, eventually, any carbon contents differences between the matrix and the enhancement phase can diffuse from where carbon is high to where carbon is low, such that in the final product there is no η phase in neither the matrix phase nor the enhancement phase.

The particulate metal binder for each of the matrix mixture and the enhancement mixture can be the same or different from one another. Suitable metal binder can comprise Co, Ni, Fe, or an alloy thereof. In some cases, the particle size of the particulate metal binder can be the same as the corresponding particulate tungsten carbide. However, in other cases, the particle size can vary between the matrix mixture and the enhancement mixture.

Optionally, the primary metal binder and the secondary metal binder have the same composition. In such cases, the binder concentration in the first grade (matrix, bulk) and the binder concentration in the second grade (the enhancement phase in the form of granules or top surface layer) can be within 5% by volume of one another in order to minimize diffusion of metal binder between the matrix and enhancement phases, and in other cases within 2% by volume. In some cases, concentrations of the binder in the first and second grades are substantially the same. In an alternative, the binder concentration in the first and second grades can differ from one another. In another alternative, the binder composition in the first and second grades can differ from one another.

Metal binder concentrations can vary depending on the desired quality and properties of the functionally design cemented tungsten carbide. However, as a very general guideline, the first and second binder concentrations can be from 3 to 20% by weight of the respective particulate mixtures, and in some cases from 6 to 16% by weight The grain growth inhibitor can be introduced into the enhancement phase in order to selectively inhibit growth of WC grains in that phase during sintering. Non-limiting examples of suitable grain growth inhibitor can include at least one of Cr, V, Ta, Ti, Nb, and carbides thereof. Specific non-limiting examples of these carbides can include $Cr_3C_2$, VC, TaC, TiC, NbC, and the like. In some cases a mixture of different grain growth inhibitors can be used to provide improved performance for certain material combinations and conditions. Non-limiting examples of such mixtures can include $Cr_3C_2$/VC, TiC/TaC, and the like. The choice of grain growth inhibitor can directly impact choice of the sintering temperature. For example, the sintering temperature and sintering time can be chosen to avoid substantial, or in some cases any, migration of inhibitors into the matrix phase. As a general rule, this will leave a relatively small window for suitable sintering temperatures. As an example, for cobalt as the metal binder, and sintering temperature of 1380 to 1440° C. can be suitable. Sintering times of 0.5 to 3 hours can also be used. As another example, for and cobalt as the metal binder, a sintering temperature of 1410 to 1430° C. can be suitable. Suitable sintering times can also be a function of particle sizes (i.e. smaller particle sizes generally dictate lower sintering times to avoid grain growth, although larger particle sizes can allow for increased interstitial diffusion of molten metals). The grain growth inhibitor can also generally comprise from about 0.1 to 1% by weight of the enhancement mixture, and in some cases 0.2 to 0.6% by weight.

In some cases, the grain growth inhibitor can be present only in the enhancement phase. In such cases, the particulate matrix mixture and the matrix phase are substantially free of the grain growth inhibitor. However, in some circumstances a minor amount of grain growth inhibitor can also be introduced into the matrix mixture. In other cases, a minor amount of grain growth inhibitor may diffuse into matrix regions adjacent to the enhancement phase. In either case, the minor amount can be less than about 0.05% by weight, and most often less than about 0.2%, if present.

Referring now to FIG. 2A-2D, a functionally designed cemented tungsten carbide material 200 is illustrated as a monolithic compact 202 in which the enhancement phase is present as a dispersed granular phase 206 within a matrix phase 208 as illustrated by enlarged region 204. The dispersed granular phase can be formed by at least partially sintering or otherwise agglomerating a mixture of the secondary particulate tungsten carbide 212A and the secondary particulate metal binder 214A to form a composite granular mixture where individual granules 206 include the secondary particulate tungsten carbide 212A, the secondary particulate metal binder 214A, and the grain growth inhibitor 216.

In one example, the secondary particulate tungsten carbide, the secondary particulate metal binder, and the grain growth inhibitor can be mixed in a suitable milling media and ball milled to a desired particle size. The milled mixture can then be spray dried to form composite granules. These composite granules can then optionally be subjected to a pre-sintering or agglomeration heating step in order to form relatively rigid hard and discrete agglomerated composite granules. The pre-sintering heating step can heat the granules to a pre-sintering temperature of about 600° C. to 950° C. to form a partially sintered or consolidated mass as composite granules.

Figure 2A:
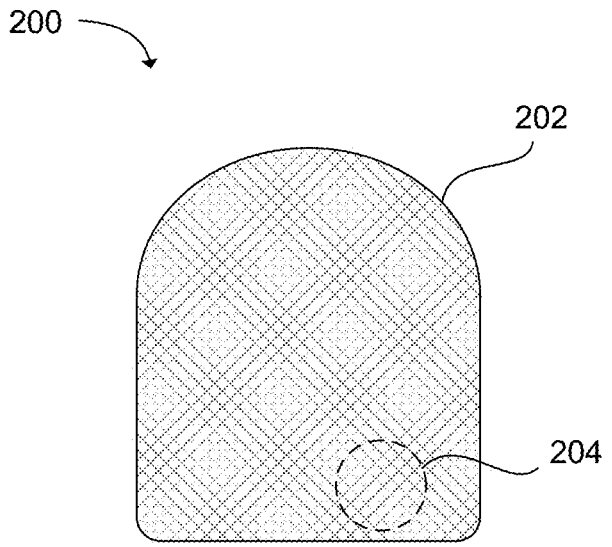
FIG. 2A is a schematic of a functionally designed cemented tungsten carbide having a dispersed enhancement phase within a matrix phase in accordance with one example.
Figure 2B:
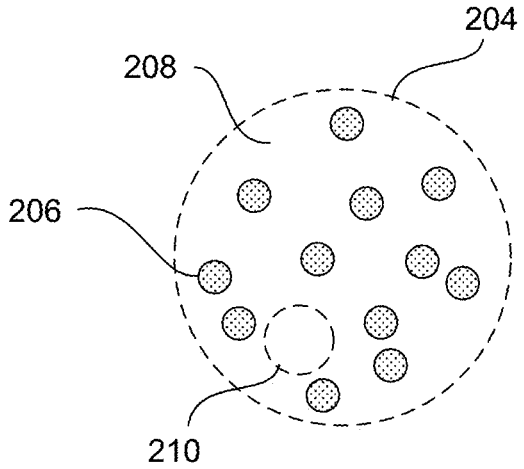
FIG. 2B is an enlarged view of a section of the functionally designed cemented tungsten carbide of FIG. 2A showing dispersed granules.
Figure 2C:
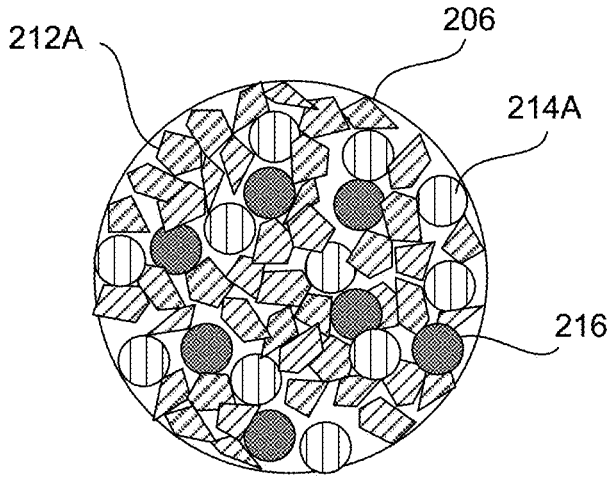
FIG. 2C is an enlarged view of a dispersed composite granule from FIG. 2B.
Figure 2D:
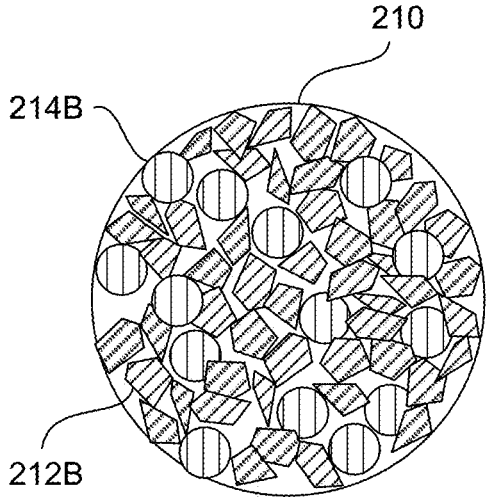
FIG. 2D is an enlarged view of a section of the matrix phase of the functionally designed cemented tungsten carbide of FIG. 2B.

When the composite granules 206 of the enhancement mixture are combined with the matrix mixture, each composite granule then becomes a single dispersed phase region resulting in a matrix mixture having composite granules dispersed throughout to form the dispersed enhancement phase. The composite enhancement granules can then be mixed with the matrix powder so that the enhancement granules can be uniformly distributed within the matrix powder. FIG. 2D illustrates a matrix region 210 of the matrix phase 208 which includes the primary tungsten carbide 212B and primary particulate metal binder 214B.

Regardless of the manner of forming the enhancement phase of the dispersed granules, the dispersed granular phase can generally comprise 1% to 50%, and in some cases 50% to 35% by volume of the functionally designed cemented tungsten carbide. The sizes of the granules can also vary, but are often approximately 20-500 micrometers, or in some cases 30-200 micrometers in an as-sintered state.

Figure 3:
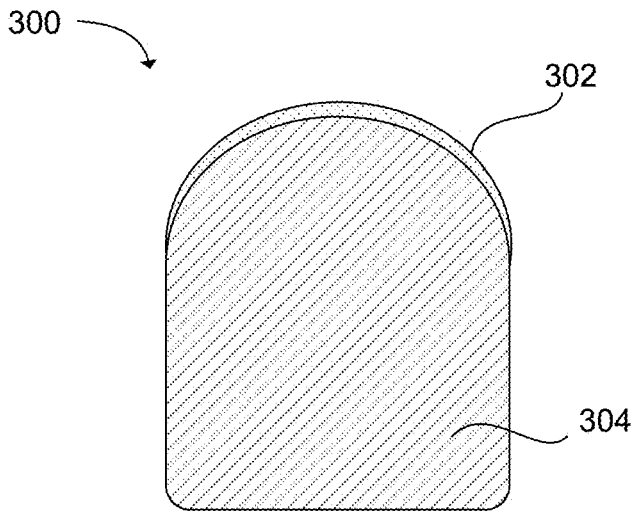
FIG. 3 is a schematic of a functionally designed cemented tungsten carbide having an enhancement phase formed as a surface layer on a matrix phase in accordance with another example.

Although the dispersed phase configuration can be advantageous for certain tools, a hard surface layer with an underlying tough support can be desirable for other applications. As shown in FIG. 3, the functionally designed cemented tungsten carbide 300 can include an enhancement phase as a surface layer 302 oriented on a matrix phase 304. The particulate enhancement mixture can be formed as described above, as a loose powder mixture, or the like. The matrix phase 304 can be formed as described above. In this case, the particulate enhancement mixture can be deposited into a mold separately from the matrix mixture. For example, a green compact before sintering can be formed by filling a die with finer grade material of the enhancement mixture first, and then filling the die with a coarser grade material of the matrix mixture. As before, sintering can be conducted at a temperature so that the grain growth inhibitor in the enhancement mixture will not diffuse into the main body, or at least not in substantial amounts to offset the grain size differential between the surface layer and the matrix. Therefore, there is none or a minor amount of mixing of the grains in the surface layer with the main body of the component. A thickness of the surface layer can be varied, but is often less than 3 mm, and the thickness may vary depending the size and volume of the substrate body. For example, if the diameter of the substrate compact is 5, 10, and 20 mm respectively, the thickness of the surface layer can be 1, 2, and 3 mm respectively.

Figure 4:
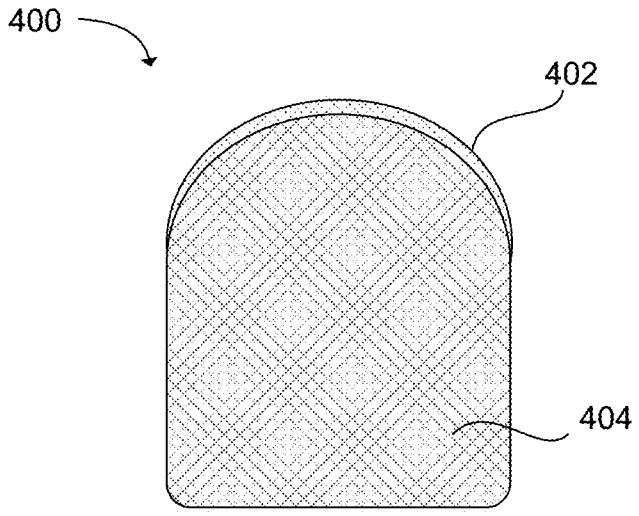
FIG. 4 is a schematic of a functionally designed cemented tungsten carbide having an enhancement phase formed as both a dispersed phase and as a surface layer on a matrix phase in accordance with another example.

FIG. 4 illustrates a functionally designed cemented tungsten carbide 400 which includes both an enhancement phase as a surface layer 402 and a main body 404 which includes a dispersed granular phase within a matrix as outlined above in reference to FIGS. 2A-2D. This combined approach can provide enhanced wear resistance both at the surface and throughout the entire body.

Optionally, the structured composite can include multiple enhancement mixtures. For example, the dispersed granular phase may include a plurality of different composite granules with different particle sizes, metal binders, and/or grain growth inhibitors. In one example, individual the structured composite and enhancement phase can include a second particulate enhancement mixture which is different from the particulate enhancement mixture. In another example, additional surface layers can include additional different enhancement mixtures. In this way, one or more surface layers can be formed having controlled and varied grain sizes, hardness, and toughness with an underlying cemented tungsten carbide matrix support. These additional layers can be introduced into either a uniform matrix support as described with respect to FIG. 3, or with a dispersed granular phase as described with respect to FIG. 4.

In any of these configurations, the mixed powder and structure composite can then be compacted into a shape of a component, e.g. rock drill bit inserts, using a die and a punch on a uniaxial press, or other commonly used shaping and compacting methods. Alternatively, a sintered blank material can be milled or machined to a final shape.

Referring again to FIG. 1, in any one of the above configurations, the structured composite can be sintered 140 to form the functionally designed cemented tungsten carbide. The sintering can be performed at a sintering temperature and a sintering time which is sufficient to sinter the continuous phase to form a matrix having a primary grain size, and to sinter the at least one of the dispersed granular phase and the surface layer having a secondary grain size to form an enhancement phase. The sintering temperature, sintering time, and composition, size and content of each of the above discussed components are chosen such that a differential in grain size is maintained upon completion of sintering. The differential grain size can range considerably, and in some cases is from 20 to 200%, and in some cases 30 to 100% difference.

The sintering temperature can be selected such that the grain growth inhibitors in the enhancement granules do not diffuse substantially into the matrix phase in a significant way. In addition, the sintering temperature can be controlled such that WC grains in the matrix phase do not mix with the WC grains in the enhancement phase, or at least do not mix sufficient to eliminate a desired and target grain size differential. In general, a densification temperature of the enhancement phase which contains grain growth inhibitor can be slightly higher than that of the matrix phase which contains no grain growth inhibitor. The resulting gap between their respective densification temperatures provide a temperature window for sintering of the cemented tungsten carbide. While sintering within this temperature window, the metallic binder in the granules is not liquid enough to flow substantially, therefore, the migration of the liquid phase and the grains within the enhancement phase will be insufficient to eliminate the differential grain size. The diffusion of the grain growth inhibitor will also be either non-existent or insufficient to eliminate a desired differential grain size between the enhancement phase and the matrix. The diffusion of carbon will eventually equalize the carbon content in the enhancement phase and the matrix phase during the later stages of the sintering.

Thus, after sintering, there will be a difference between the grain sizes within the enhancement granules and the matrix. This differential in grain size, also produces a substantial difference in hardness between the matrix and the enhancement phase. The actual difference in hardness depends on the selection of the grain sizes for the matrix and the enhancement phase respectively. As an example, a hardness difference can be greater than 50 Hv (Vickers Hardness). As a general guideline, the hardness difference between the matrix and the enhancement phase can be less than 400 Hv to avoid substantial changes to the overall impact resistance of the material and the component.

As a general guideline, sintering temperatures can range from 1380 to 1460° C., and in some cases about 1400 to 1430° C. In one example, sintering can be performed at 1410° C. under vacuum. Sintering times can also vary considerably depending on the materials and starting particle sizes. However, sintering times can often range from 30 minutes to 2 hours, and most often 30 to 60 minutes at the temperature. The functionally designed cemented tungsten carbide can also be produced by sinter-HIP, which is a vacuum sintering plus a low pressure (<10 MPa) hot isostatic pressing step in a common furnace as a part of the sintering cycle. In some cases, sintering can be performed under vacuum.

In some cases, the functionally designed cemented tungsten carbide is partially sintered. In other cases, the functionally designed cemented tungsten carbide is fully sintered in which case the sintered tungsten carbide can also be fully densified. As an example, porosity in the sintered cemented tungsten carbide can be less than A04B04C04 per ASTM B276-91 (2010) standard, and most often less than A02B00C02.

Optionally, the carbon content of the material can be high enough such that there are no complex carbides in the material. The complex carbides, that have lower carbon content than that of tungsten carbide (WC), may be undesired brittle carbides of tungsten and metal binder, and can form when the total carbon content is excessively low. When the metal binder is cobalt, the complex carbide is η-phase with a typical formula of $Co_3W_3C$. If such complex carbides are present in the sintered material, a carburizing treatment may be applied to remove the complex carbides. Such a carburizing step can be performed by subjecting the sintered material to a carburizing atmosphere. For example, the atmosphere can include methane, carbon dioxide, carbon monoxide, and the like, and may include optional carrier gases such as nitrogen, argon or the like. Furthermore, heat treatment steps and other pre- and post-processing can be performed as outlined in the afore-mentioned U.S. Patent Application Publication No. 2005/0276717, U.S. Pat. Nos. 5,880,382; 8,163,232; 8,936,750; and 9,388,482.

Using these principles a functionally designed cemented tungsten carbide can be formed having a highly controlled and functionally designed microstructure in which grain size is not uniformly distributed. The matrix phase can comprise the sintered cemented tungsten carbide having a primary grain size. The enhancement phase comprises the second sintered cemented tungsten carbide having the secondary grain size and the grain growth inhibitor distributed within the enhancement phase. As discussed, the primary grain size is larger than the secondary grain size after sintering. For materials where the enhancement phase and the matrix phase have substantially the same composition, a smaller grain size in the enhancement phase still results in a higher hardness in the enhancement phase, with a lower toughness. Thus, in this manner, the microstructure can be carefully and precisely controlled to vary within different regions (i.e. the continuous matrix phase versus one or more enhancement phases).

The functionally designed cemented tungsten carbide material can be used in a wide variety of tools such as, but not limited to, rock drilling compacts and inserts such as those used in oil and gas exploration, mining and construction, high performance metal machining tool such as, twist drills, turning bits, indexable turning inserts, end mills, reamers, burrs and the like. The functionally designed cemented tungsten carbide material can also be advantageously incorporated into various engineered wear parts such as, but not limited to, mechanical seals, punches, dies, drawing tools, stamping tools, forging tools, bearings, water jet cutting nozzles, automotive parts, turbine blades, high speed mixers, and the like. These functionally designed cemented tungsten carbide material can be brazed, welded, mechanically secured, or otherwise attached to a corresponding tool substrate. However, in some cases, the functionally graded cemented tungsten carbide material can be formed integrally with the tool substrate.

Another application for these functionally designed cemented tungsten carbides are as a substrate for additional coatings. For example, these cemented tungsten carbide tools for metal machining tools can be coated with ceramic materials such as TiN, TiC, $Al_2O_3$, CrN, TiCN, and other suitable hard ceramic materials (e.g. synthetic diamond, cubic boron nitride, etc), and combinations of them in alternating layers. The thickness of individual coating layers can range from a few nanometers to tens of micrometers. Such coatings can be deposited by any suitable technique such as, but not limited to, chemical vapor deposition, physical vapor deposition, atomic layer deposition, and the like. Corresponding coating materials are not particularly limited, although inorganic and hard materials such as nitrides, carbides, metal oxides, and diamond can be of particular interest. Non-limiting examples of coating materials can include TiN, TiC, TiCN, TiAlN, $Al_2O_3$, diamond (including amorphous diamond, polycrystalline diamond and monocrystalline diamond).

Example 1

1) A matrix phase powder was prepared by ball milling the mixture of the first tungsten carbide powder and 6% wt cobalt powder in a solvent with 2% wt polymeric binder according to common, normal production methods. The grain size and the cobalt content of the mixture was designed to have a hardness of HRa 90.4 if it is sintered alone according to widely commercialized formulations and procedures. The matrix phase powder was spray dried.

2) A granular enhancement phase was prepared by a) adding the second tungsten carbide powder 6% cobalt powder, and 0.25% $Cr_3C_2$ powder. The carbon content of the mixture was deliberately adjusted so that there is minimum flow of the cobalt phase from the matrix to the enhancement phase. The grain size and cobalt content of the mixture were designed to have a hardness of HRa 91.4 if it is sintered alone according to widely commercialized formulations and procedures. b) the mixture was ball milled according to the normal production method, c). the enhancement phase powder was spray dried, d). the enhancement phase powder was pre-sintered to obtain discrete partially sintered granular enhancement phase powder.

3) The spray dried matrix phase powder and the pre-sintered granular enhancement phase powder were mixed to obtain the composite powder. The volume fraction of the enhancement phase powder was 30%.

4) The composite powder was compacted on a uniaxial die press into specimens with various geometries appropriate for testing different mechanical properties.

5) The compacted composite material was sintered at 1410° C. All other details of the sintering process is consistent with standard, commonly practiced procedures for production of cemented tungsten carbide products.

6) Mechanical properties were tested on the sintered specimens. The results are presented in Table 1.

TABLE 1

| | Hardness (HRa) | Transverse rupture strength (TRS, MPa) | Fracture toughness (KIc, MPa/m$^{1/2}$) | Wear Resistance (ASTM B611) |
|---|---|---|---|---|
| Standalone matrix phase | 90.3 | 2950 | 12.69 | 22.17 |
| FDM without surface layer | 90.4 | 2850 | 12.82 | 28.50 |
| FDM with surface layer | 90.4 | 2850 | 12.82 | 51.77 |

Example 2

1). The matrix phase powder was prepared as described in Example 1.

2). The granular enhancement phase was prepared by a) adding the second tungsten carbide powder 6% cobalt powder, and 0.25% Cr3C2 powder. The carbon content of the mixture was deliberately adjusted so that there is minimum flow of cobalt from the matrix to the enhancement phase. The grain size and cobalt content of the mixture were designed to have a hardness of HRa 91.4 if it is sintered alone according to widely commercialized formulations and procedures. b) the mixture was ball milled according to the normal production method.

3). A green compact was produced by first filling the die with the enhancement phase powder, and compacting it with a low pressure, then filling the die with the matrix powder, and compacting with high pressure as it would in a normal production. The green compact had various geometries appropriate for testing different mechanical properties.

5). The composite material was sintered at 1410° C. All other details of the sintering process was consistent with the standard, commonly practiced procedures for production of cemented tungsten carbide products. The sintered product had a surface layer consisting of the enhancement phase on top of the substrate consisting of the matrix phase. The thickness of the surface layer varied from less than 1 mm to 5 mm.

6) Mechanical properties were tested on the sintered specimens. The results are presented in Table 1.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A functionally designed cemented tungsten carbide, comprising:

a) a matrix phase comprising a sintered cemented tungsten carbide having a primary grain size; and b) an enhancement phase comprising a second sintered cemented tungsten carbide having a secondary grain size and a grain growth inhibitor distributed within the enhancement phase, wherein the primary grain size is larger than the secondary grain size and wherein the grain growth inhibitor is also distributed within the enhancement phase at a higher concentration than in the matrix phase prior to sintering.

2. The functionally designed cemented tungsten carbide of claim 1, wherein the enhancement phase is formed as discrete composite granules dispersed within the matrix phase to form a dispersed phase.

3. The functionally designed cemented tungsten carbide of claim 2, wherein the dispersed enhancement phase comprises 10% to 40% by volume of the functionally designed cemented tungsten carbide.

4. The functionally designed cemented tungsten carbide of claim 1, wherein the enhancement phase is formed as a surface layer.

5. The functionally designed cemented tungsten carbide of claim 4, wherein the surface layer has a thickness of 1 mm to 3 mm.

6. The functionally designed cemented tungsten carbide of claim 1, wherein the enhancement phase includes both a dispersed phase and a surface layer, wherein the dispersed phase is formed as discrete composite granules distributed within the matrix phase.

7. The functionally designed cemented tungsten carbide of claim 1, wherein the grain growth inhibitor comprises at least one of Cr, V, Ta, Ti, Nb, and carbides thereof.

8. The functionally designed cemented tungsten carbide of claim 1, wherein the size of the granular enhancement phase is from 30 to 300 μm.

9. The functionally designed cemented tungsten carbide of claim 1, wherein the matrix phase has substantially less of the grain growth inhibitor than the granular enhancement phase.

10. The functionally designed cemented tungsten carbide of claim 1, which is substantially free of η phase carbides and free carbon.

11. The functionally designed cemented tungsten carbide of claim 1, wherein the granular enhancement phase has a hardness which is at least 50 Hv greater than a hardness of the matrix phase.

12. The functionally designed cemented tungsten carbide of claim 11, wherein a hardness difference between the matrix phase and the enhancement phase is also less than 400 Hv.

13. The functionally designed cemented tungsten carbide of claim 1, wherein the primary grain size is from 1 μm to 20 μm and the secondary grain size is 100 nm to 2 μm.

14. The functionally designed cemented tungsten carbide of claim 1, wherein the secondary grain size is at least 20% smaller than the primary grain size.

15. The functionally designed cemented tungsten carbide of claim 1, wherein the primary grain size had a starting primary grain size prior to sintering and the secondary grain size had a starting secondary grain size prior to sintering, wherein the starting primary grain size was larger than the starting secondary grain size prior to sintering.

16. The functionally designed cemented tungsten carbide of claim 1, wherein the matrix phase is free of grain growth inhibitor prior to sintering.

* * * * *